US005113823A

United States Patent [19]

Iriyama

[11] Patent Number: 5,113,823

[45] Date of Patent: May 19, 1992

[54] THROTTLE VALVE CONTROL APPARATUS FOR USE WITH INTERNAL COMBUSTION ENGINE

[75] Inventor: Masahiro Iriyama, Kanagawa, Japan

[73] Assignee: Nissan Motor Company, Limited, Yokohama, Japan

[21] Appl. No.: 678,875

[22] Filed: Apr. 4, 1991

[30] Foreign Application Priority Data

Apr. 6, 1990 [JP] Japan ..... 2-91614
Apr. 6, 1990 [JP] Japan ..... 2-91615
Jun. 29, 1990 [JP] Japan ..... 2-170254

[51] Int. Cl.[5] ..... F02D 7/00
[52] U.S. Cl. ..... 123/399; 123/361
[58] Field of Search ..... 123/399, 361, 352, 400, 123/401, 478, 340, 148 D, 630; 364/431.07, 426.04; 180/197

[56] References Cited

U.S. PATENT DOCUMENTS 4,960,091 10/1990 Aufmkolk ..... 123/399
4,962,570 10/1990 Haraka et al. ..... 123/399
4,969,431 11/1990 Wataya ..... 123/399
4,972,817 11/1990 Wilde et al. ..... 123/399
4,979,117 12/1990 Hattori et al. ..... 364/431.07
4,986,238 1/1991 Terazawa ..... 123/361

*Primary Examiner*—Raymond A. Nelli
*Attorney, Agent, or Firm*—Foley & Lardner

[57] ABSTRACT

A throttle valve control apparatus for use with an internal combustion engine having a throttle valve urged in a given direction by means of a return spring performs throttle position control to bring a throttle valve to a required position. Prior to the throttle position control, a sensed throttle valve position is compared with a predetermined value. When a difference between the sensed throttle valve position and the predetermined value is not within a predetermined range, a failure signal is produced to indicate that the return spring is subject to failure. If the throttle position control is a closed loop throttle position control employing an integral correction term, the apparatus may be arranged to produce the failure signal by comparing the integral correction term with a predetermined value after the sensed throttle valve position converges to the required throttle valve position. In the event of failure of the return spring, the throttle valve is held at a predetermined fail-safe position with the closed loop throttle position control being inhibited.

12 Claims, 7 Drawing Sheets

THROTTLE VALVE CONTROL APPARATUS FOR USE WITH INTERNAL COMBUSTION ENGINE

BACKGROUND OF THE INVENTION

This invention relates to a throttle valve control apparatus for use with an internal combustion engine having a throttle valve and, more particularly, to such an apparatus for detecting a failure of a return spring used to urge the throttle valve in an opening or closing direction.

Traction control apparatuses have been proposed to control the engine output so as to hold a slip factor within a predetermined range when slip occurs for the vehicle drive wheels. The engine output control is made by controlling the position of a throttle valve located in an air induction passage for controlling the amount of air permitted to enter the engine. For this purpose, the traction control apparatus produces a required throttle valve position for an electronic control unit which compares it with a detected throttle valve position to provide a closed loop control signal in response to a sensed deviation of the detected throttle valve position from the required throttle valve position. The closed loop control signal is used to drive a throttle valve actuator so as to move the throttle valve in a direction zeroing the sensed deviation.

The traction control apparatus is applicable to a single throttle structure having a single throttle valve located within an engine induction passage and also to a tandem throttle structure having main and auxiliary throttle valves located in series within an engine induction passage. The main throttle valve is connected through a mechanical linkage to an accelerator pedal and the auxiliary throttle valve is connected to a throttle valve actuator controlled by the electric control unit.

For such a single throttle structure, the electric control unit normally controls the throttle valve in response to a change in the position of an accelerator pedal and in response to the required throttle valve position fed from the traction control apparatus when slip occurs for the vehicle drive wheels. For such a tandem throttle structure, the electric control unit normally controls the throttle valve actuator to hold the auxiliary throttle valve in its fully-open position and controls the throttle valve actuator to move the auxiliary throttle valve in a closing direction when slip occurs for the vehicle drive wheels.

Normally, a return spring is used to urge the throttle valve in a closing direction for the single throttle structure and to urge the auxiliary throttle valve in an opening direction for the tandem throttle structure. The control unit employs the return spring to move the throttle valve to a fail-save position in the event of failure of the components used for the throttle valve control. In the event of failure of the return spring itself, however, the fail-safe operation will be invalid. There have been proposed no means for detecting a failure of the return spring in spite of the fact that it is very difficult to check the failure of the return spring from the operation of the throttle valve.

SUMMARY OF THE INVENTION

Therefore, it is a main object of the invention to provide a throttle valve control apparatus which can accurately check a failure of a return spring used to urge a throttle valve in an opening or closing direction.

Another object of the invention is to provide a throttle valve control apparatus which can perform appropriate fail-safe control in the event of failure of the return spring.

There is provided, in accordance with the invention, an apparatus for use with an internal combustion engine having a throttle valve movable between fully-open and fully-closed positions within an induction passage for controlling air flow to the engine, and a return spring for urging the throttle valve in a given direction. The apparatus comprises a throttle position sensor sensitive to a position of the throttle valve for generating an electric signal indicative of a sensed position of the throttle valve, a signal source for generating an electric signal indicative of a required position of the throttle valve, and a control unit connected to the throttle position sensor and also to the signal source. The control unit includes means for performing throttle position control to bring the throttle valve to the required position, and means operable, prior to throttle position control, for comparing the sensed throttle valve position with a predetermined value to produce a failure signal indicative of failure of the return spring when a difference between the sensed throttle valve position and the predetermined value is out of a predetermined range.

In another aspect of the invention, there is provided an apparatus for use with an internal combustion engine having a throttle valve movable between fully-open and fully-closed positions within an induction passage for controlling air flow to the engine, and a return spring for urging the throttle valve in a given direction. The apparatus comprises a throttle position sensor sensitive to a position of the throttle valve for generating an electric signal indicative of a sensed position of the throttle valve, a signal source for generating an electric signal indicative of a required position of the throttle valve, and a control unit connected to the throttle position sensor and also to the signal source. The control unit includes means for providing closed loop throttle position control employing an integral correction term or amount in response to a sensed deviation of the sensed throttle valve position from the required throttle valve position so as to bring the throttle valve to the required position, means for comparing the integral correction term or amount with a predetermined value to produce a failure signal indicative of failure of the return spring after the sensed throttle valve position converges to the required throttle valve position.

In another aspect of the invention, there is provided an apparatus for use with an internal combustion engine having a throttle valve movable between fully-open and fully-closed positions within an induction passage for controlling air flow to the engine, and a return spring for urging the throttle valve in a given direction. The apparatus comprises a throttle position sensor sensitive to a position of the throttle valve for generating an electric signal indicative of a sensed position of the throttle valve, a signal source for generating an electric signal indicative of a required position of the throttle valve, and a control unit connected to the throttle position sensor and also to the signal source. The control unit includes means for providing a closed loop throttle position control in response to a sensed deviation of the sensed throttle valve position from the required throttle valve position so as to bring the throttle valve to the required position, means for detecting failure of the return spring to produce a failure signal in the event of failure of the return spring, and means responsive to the failure signal for inhibiting closed loop throttle position control and holding the throttle valve at a predetermined fail-safe position.

BRIEF DESCRIPTION OF THE DRAWINGS

This invention will be described in greater detail by reference to the following description taken in connection with the accompanying drawings, in which.

DETAILED DESCRIPTION OF THE INVENTION

Figure 1:
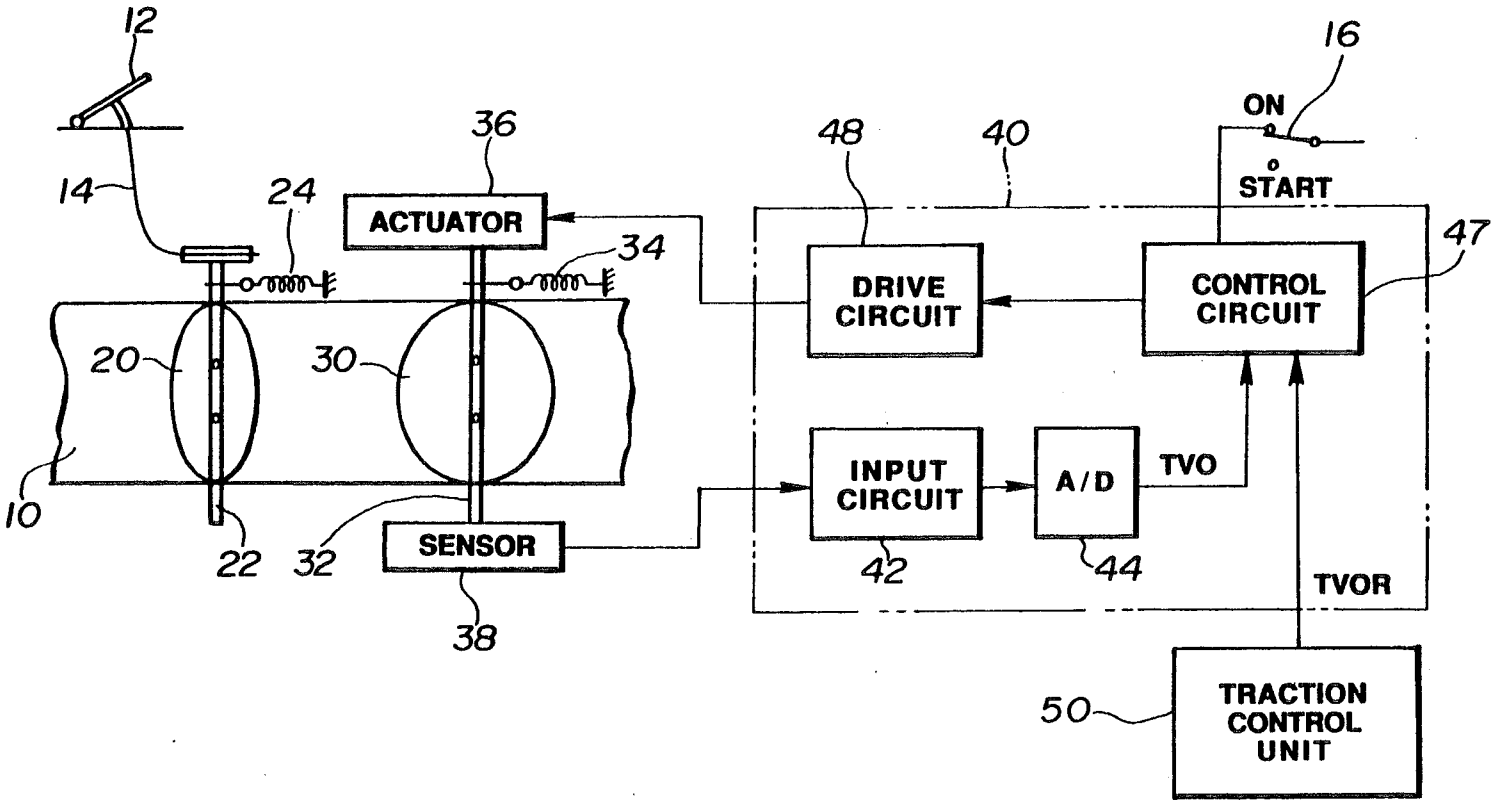
FIG. 1 is a schematic diagram showing one embodiment of a throttle valve control apparatus made in accordance with the invention.

With reference to the drawings and in particular to FIG. 1, there is shown a schematic diagram of a throttle valve control apparatus embodying the present invention. In the illustrated case, the throttle valve control apparatus is used with a tandem throttle valve mechanism having main and auxiliary butterfly throttle valves 20 and 30 located in series within an air induction passage 10. The main throttle valve 20 is mounted for rotation with a throttle shaft 22 within the air induction passage 10 for controlling the flow of air to the engine (not shown) so as to adjust the speed of rotation of the engine. The main throttle valve 20 is urged in a closing direction by a return spring 24. The main throttle valve 20 is connected by an accelerator wire 14 to an accelerator pedal 12 manually controlled by the driver. The degree to which the accelerator pedal 12 is depressed controls, through the accelerator wire 14, the degree of rotation of the main throttle valve 20. The greater the depression of the accelerator pedal 12, the greater the amount of air permitted to enter the engine.

The auxiliary throttle valve 30 is mounted for rotation with a throttle shaft 32 within the air induction passage 10 for controlling the flow of air to the engine. The auxiliary throttle valve 30 is urged in an opening direction by a return spring 34. The auxiliary throttle valve 30 is connected to an actuator 36 which may include a servo motor for rotating the throttle shaft 32 to move the auxiliary throttle valve 30 between its fully-open and fully-closed positions. The degree of rotation of the auxiliary throttle valve 30 is determined by the magnitude of a control signal applied to the actuator 36, which is determined from calculations performed by a control unit 40. For this purpose, the control unit 40 has an input from a throttle position sensor 38. The throttle position sensor 38 is connected by a mechanical link to the auxiliary throttle valve 30 for detecting the degree of opening of the auxiliary throttle valve 30. The throttle position sensor 38 may be a potentiometer electrically connected in a voltage divider circuit for supplying a detected throttle position signal in the form of a DC voltage proportional to the detected auxiliary throttle valve position. In the illustrated case, the DC voltage has a greater value as the amount to which the auxiliary throttle valve 30 is opened increases.

The control unit 40 includes an input circuit 42 which receives the detected throttle position signal from the throttle position sensor 38 and removes noise which may be superimposed on the detected throttle position signal. The detected throttle position signal is then fed from the input circuit 42 to an analog-to-digital (A/D) converter 44 which converts it into digital form for application to a control circuit 47. The control circuit 47 also receives a required throttle position signal indicative of a required auxiliary throttle valve position from a traction control unit 50. The control circuit 47 compares the detected and required throttle valve positions to provide a closed loop throttle valve control signal containing, integral, proportional and differential correction terms generated in response to the sensed deviation of the detected throttle valve position from the required throttle valve position. The closed loop throttle valve control signal is applied to a drive circuit 48 which converts it into a corresponding control signal causing the actuator 36 to make a required change in the position of the auxiliary throttle valve 30 in a direction zeroing the sensed deviation. The control ciruit 47 also performs the function of checking failure of the return spring 34 prior to initiation of the closed loop throttle position control.

The traction control unit 50 repetitively sets a required throttle position based upon the slip factor of the vehicle drive wheels and the like for traction control. The numeral 16 designates an ignition switch which is a conventional automobile type ignition switch having "ON" and "START" or "CRANK" positions. The key cylinder is normally spring biased to automatically return to the "ON" position from the "START" position on the release of the ignition key after cranking the engine. The control unit 40 is connected to the vehicle battery when the ignition switch is at the "ON" position.

The control circuit 47 may employ a digital computer which shall be regarded as including an analog-to-digital converter, a central processing unit (CPU), a read only memory (ROM), a random access memory (RAM), a nonvolatile memory, a timer counter, and a digital-to-analog converter. The read only memory contains the program for operating the central processing unit.

Figure 2:
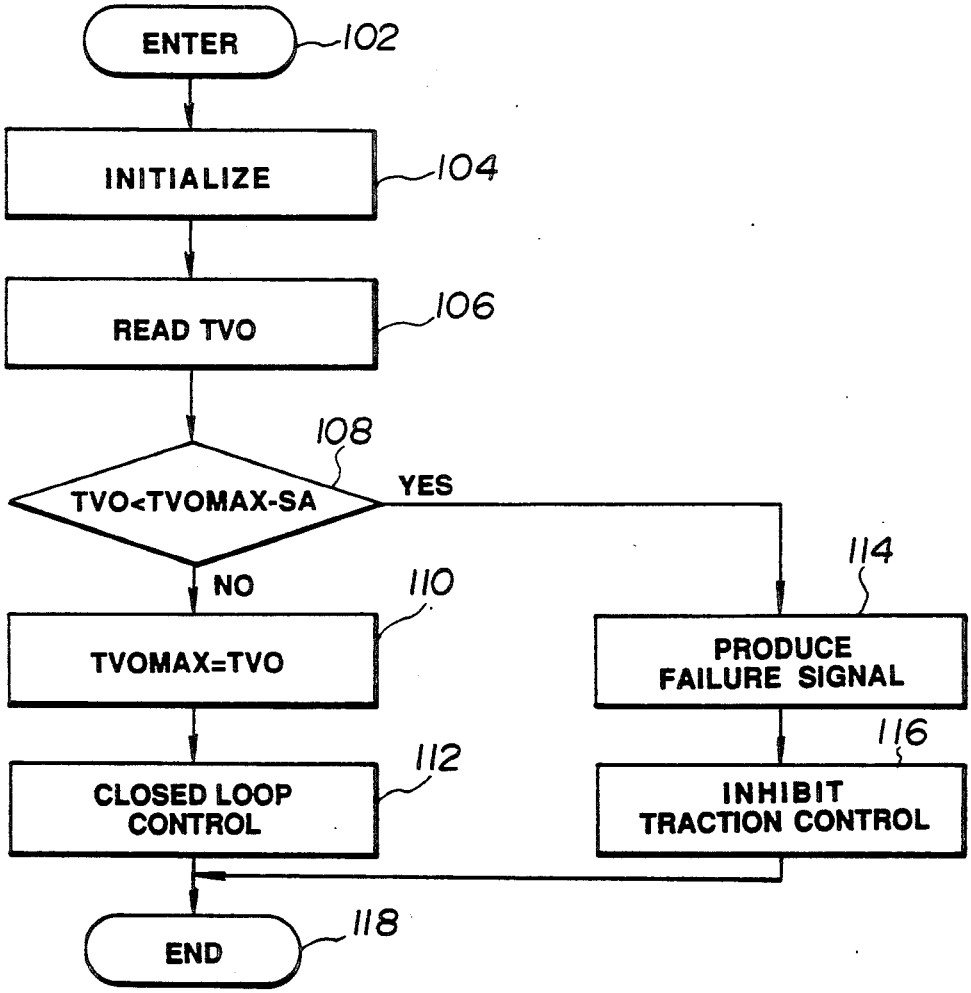
FIG. 2 is a flow diagram illustrating the programming of the digital computer used in the control circuit of FIG. 1.

FIG. 2 is a flow diagram illustrating the programming of the digital computer as it is used to check the return spring 34 prior to a closed loop throttle valve control.

The computer program is entered at the point 102 when the ignition switch 16 is changed to the "ON" position. At the point 104 in the program, initialization is made for the random access memory. Thus, the actuator 36 receives no control signal from the control unit 40 and keeps the auxiliary throttle valve 30 free to rotate. If the return spring 34 is in order or without failure, the auxiliary throttle valve 30 will be in its fully-open position.

At the point 106 in the program, the detected auxiliary throttle valve position TVO is read into the computer memory. At the point 108 in the program, a determination is made as to whether or not the detected throttle valve position TVO is less than TVOMAX minus SA where TVOMAX is a predetermined value corresponding to the fully-open position of the auxiliary throttle valve 30; that is, the detected throttle valve position to be obtained when the auxiliary throttle valve 30 is in its fully-open position and SA is a predetermined value defining an acceptable range. The acceptable range may be determined by taking errors into account, these errors including manufacturing and installing errors having an influence on the detection of the auxiliary throttle valve positions.

If the answer to this question is "no", then it means that the return spring 34 operates in order to hold the auxiliary throttle valve 30 at its fully-open position and the program proceeds to the point 110. At the point 110 in the program, the detected throttle valve position TVO is stored in the nonvolatile memory to update the predetermined value TVOMAX. The program then proceeds to the point 112 where the central processing unit performs closed loop throttle valve control. For this purpose, the central processing unit reads the required auxiliary throttle valve position and compares the detected and required auxiliary throttle valve positions to provide a closed loop throttle valve control signal for the drive circuit 48. The closed loop throttle valve control is repeated until the ignition switch is turned off. Following this, the program proceeds to the end point 118.

If the answer to the question inputted at the point 108 is "yes", then it means that the return spring 34 is subject to failure and the program proceeds to the point 114 where a failure signal is produced to perform an appropriate fail-safe operation. For example, the fail-safe operation includes producing a command to the drive circuit 48 to cause the actuator 36 to move the auxiliary throttle valve 30 to its fully-open position and producing an audible or visual alarm to indicate that the return spring 34 is subject to failure. The program then proceeds to the point 116 where the central processing unit produces a command to inhibit the traction control. Following this, the program proceeds to the end point 118.

Although the throttle valve control apparatus has been described in connection with a return spring used to urge a throttle valve in an opening direction, it is to be understood, of course, that it may be used to check a failure of a return spring used to urge a throttle valve in a closing direction. In this case, the detected throttle valve position is compared with TVOMIN plus SA where TVOMIN is a predetermined value corresponding to the fully-closed position of the throttle valve. The control circuit produces a failure signal indicative of failure of the return spring when the detected throttle valve position is greater than TOVMIN plus SA.

Although the throttle valve control apparatus is described in connection with a tandem throttle valve mechanism, it is to be understood, of course, that it is equally applicable to a single throttle valve mechanism where only a single throttle valve is provided in the air induction passage. In this case, a return spring is used to urge the throttle valve in a closing direction. Although the throttle valve control apparatus has been described in connection with a closed loop throttle valve control system, it is to be understood that it may be arranged to provide an open loop throttle valve control. In this case, the actuator 36 includes a pulse motor for controlling the throttle valve position.

Figure 3:
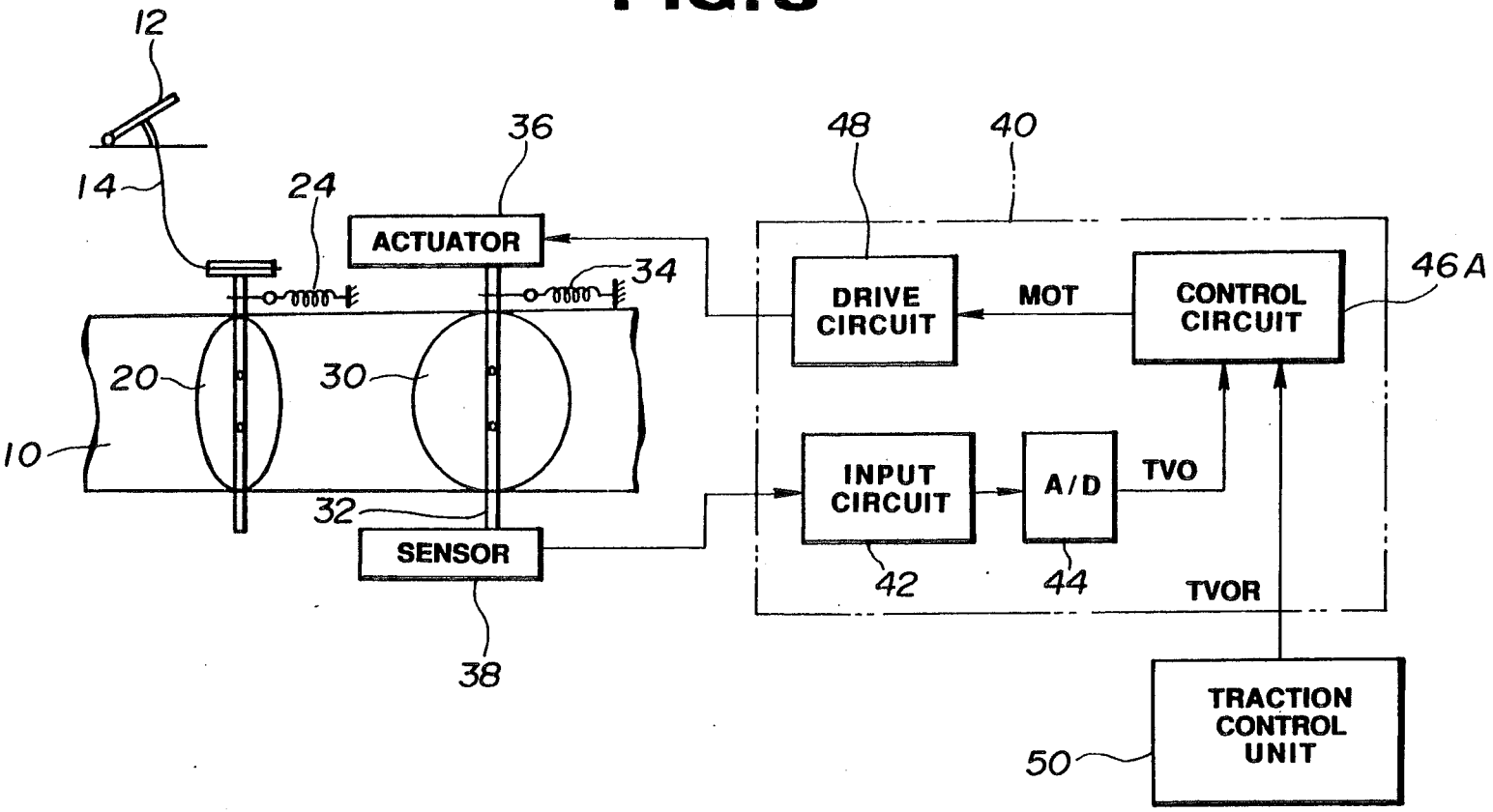
FIG. 3 is a schematic diagram showing a second embodiment of the throttle valve control apparatus of the invention.

Referring to FIG. 3, there is illustrated a second embodiment of the throttle valve control apparatus of the invention. Like reference numerals have been applied to FIG. 3 with respect to the equivalent components shown in FIG. 1. The control circuit **46*a* provides a closed loop throttle position control employing an integral correction term in response to a sensed deviation of the detected throttle valve position TVO from the required throttle valve position TVOR so as to bring the auxiliary throttle valve 30 to the required position. In this embodiment, a failure of the return spring 34 is checked during closed loop control. The control circuit 46*a*** compares the integral correction term with a predetermined value to produce a failure signal indicative of a failure of the return spring after the detected throttle valve position comes into coincidence with the required throttle valve position.

Figure 4:
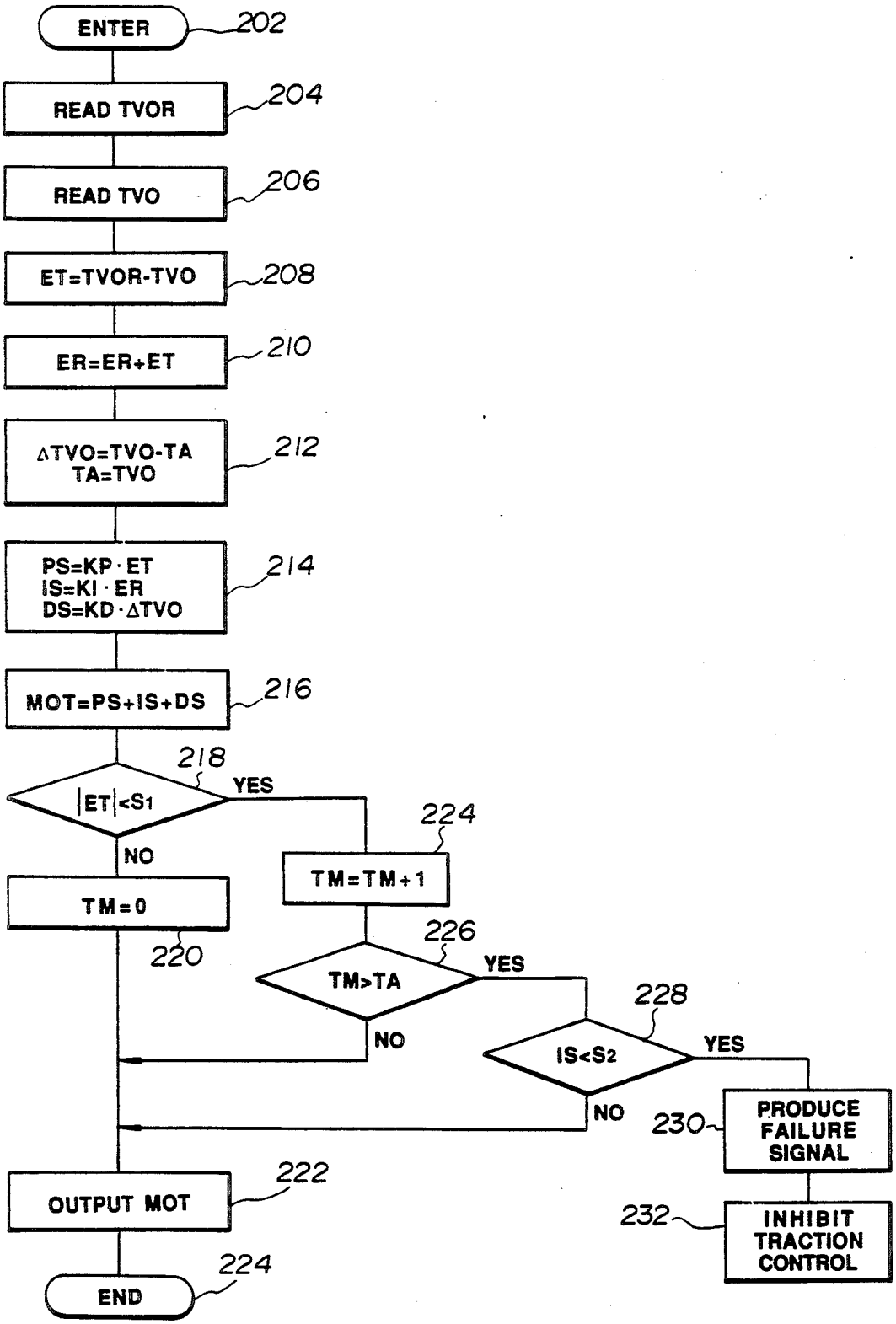
FIG. 4 is a flow diagram illustrating a modified form of the programming of the digital computer used in the control circuit of FIG. 1.

FIG. 4 is a flow diagram illustrating a modified form of the programming of the digital computer used in the control circuit **46*a***.

The computer program is entered at the point 202 at uniform intervals of time or in synchronism with engine rotation. At the point 204 in the program, the required throttle position TVOR is read into the computer memory. At the point 206 in the program, the detected throttle valve position TVO is read into the computer memory.

At the point 208 in the program, an error ET of the detected throttle valve position TVO from the required throttle valve position TVOR is calculated. At the point 210 in the program, a new sum total ER is calculated by adding the calculated error ET to the last sum total ER of the error ET calculated at the point 208 in the previous cycles of execution of the program. The new sum total ER is stored to update the last sum total. At the point 212 in the program, the central processing unit calculates a difference ΔTVO of the last throttle valve position TA from the new throttle valve position TVO read at the point 206 and stores the new throttle valve position TVO to update the last throttle valve position TA.

At the point 214 in the program, the central processing unit calculates a proportional correction term PS by multiplying the calculated error ET by a predetermined constant KP, an integral correction term IS by multiplying the calculated sum total ER by a predetermined constant KI, and a differential correction term DS by multiplying the calculated difference ΔTVO by a predetermined constant KD. At the point 216 in the program, the central processing unit calculates a required value MOT for a change of position of the auxiliary throttle valve 30 by summing the proportional, integral and differential terms PS, IS and DS.

At the point 218 in the program, a determination is made as to whether or not the absolute value of the calculated error ET is less than a reference value S1. If the answer to this question is "no", then it means that the error ET is outside of an acceptable range defined by the reference value S1 and the program proceeds to the point 220 where the count TM of a timer counter is cleared to zero and then to the point 222 where the required value MOT is transferred to the drive circuit 48. The drive circuit 48 converts the transferred value MOT into a corresponding current value to drive the servo motor 36. Following this, the program proceeds to the end point 234.

If the answer to the question inputted at the point 218 is "yes", then it means that the error ET has been reduced to within the acceptable range defined by the reference value S1 and the program proceeds to the point 224 where the count TM of the timer counter is incremented. The program then proceeds to a determination step at the point 226. This determination is as to whether or not the count TM of the timer counter is greater than a predetermined value TA. If the answer to this question is "no", then the program proceeds to the point 222. Otherwise, it means that a predetermined time has been elapsed after the absolute value of the error ET arrives at the reference value S1 and the program proceeds to another determination step at the point 228. This determination is as to whether or not the integral correction term IS is less than a reference value S2. The actuator 36 is required to produce a force to hold the auxiliary throttle valve 30 at the required position against the resilient force of the return spring 34. This force corresponds to the integral correction term IS. Thus, the integral correction term IS is not zero when the return spring 34 operates in order or without failure. In the event of failure of the return spring 34, the integral correction term IS is reduced to zero when the auxiliary throttle valve 30 reaches the required position.

If the answer to this question is "no", then it means that the return spring 34 operates in order or without failure and the program proceeds to the point 222. Otherwise, it means that the return spring 34 is subject to failure and the program proceeds to the point 230 where a failure signal is produced to perform an appropriate fail-safe operation. For example, the fail-safe operation includes producing a command for the drive circuit 48 to cause the actuator 36 to move the auxiliary throttle valve 30 to its fully-open position and producing an audible or visual alarm to indicate that the return spring 34 is subject to failure. The program then proceeds to the point 232 where the central processing unit produces a command to inhibit traction control. Following this, the program proceeds to the end point 234.

The operation of the throttle valve control apparatus of the invention is further described with reference to FIGS. 5A, 5B, 6A and 6B.

Figure 5A:
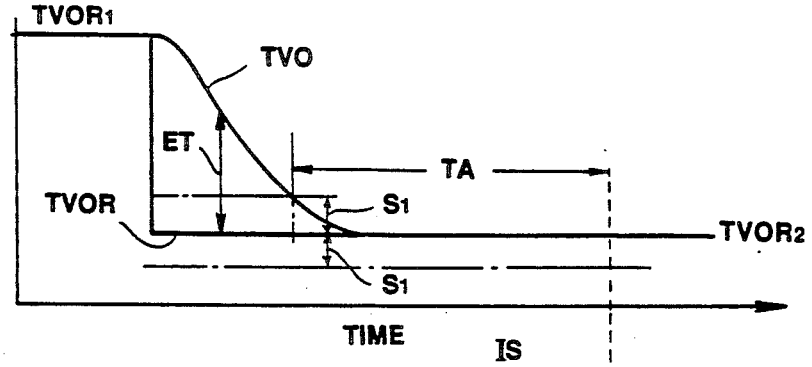
FIGS. 5A and 5B are graphs used in explaining the operation of the throttle valve control apparatus when the return spring operates in order or without failure.

Assuming first that the return spring 34 operates in order or without failure. The throttle valve control apparatus provides closed loop throttle valve control to change the detected throttle valve position TVO in response to a stepped change of the required throttle valve position TVOR from a value TVOR1 which indicates the fully-open position of the auxiliary throttle valve 30 to a value TVOR2, as shown in FIG. 5A. The error ET between the detected and desired throttle valve positions TVO and TVOR decreases with the lapse of time. When the detected throttle valve position TVO comes within a predetermined range around the required throttle valve position TVOR, the timer counter starts counting clock pulses.

Figure 5B:
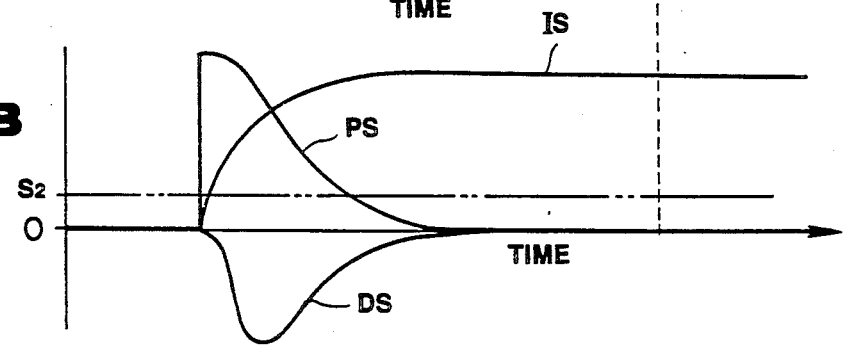

During closed loop throttle valve control, the integral correction term IS increases until the detected throttle valve position TVO reaches the required throttle valve position TVOR, as shown in FIG. 5B. After the detected throttle valve position TVO reaches the required throttle valve position TVOR, the integral correction terms IS is held at a constant value much greater than the reference value S2 to balance the force produced by the actuator 36 with the resilient force of the return spring 34. The resilient force of the return spring 34 increases as the auxiliary throttle valve 34 moves in the closing direction. Thus, it is preferable to select the reference value S2 as a function of required throttle valve position TVOR. In this case, the control circuit 47 may include a look-up table having addressable reference value storage locations each being addressable as a function of required throttle valve position TVOR.

Figure 6A:
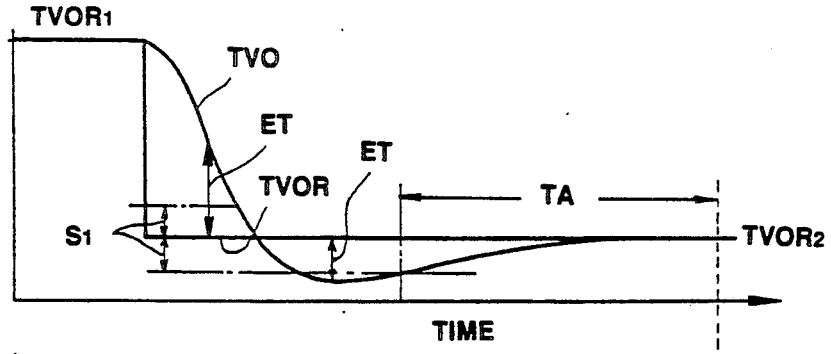
FIGS. 6A and 6B are graphs used in explaining the operation of the throttle valve control apparatus in the event of failure of the return spring.
Figure 6B:
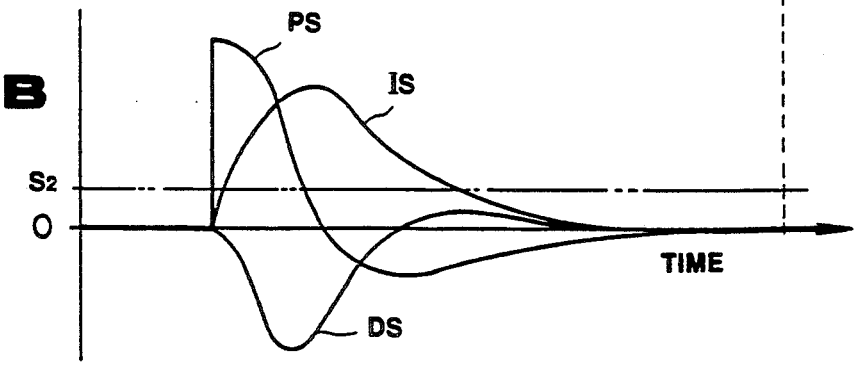

In the event of failure of the return spring 34, the detected throttle valve position TVO overshoots the required throttle valve position TVOR and then comes into coincidence with the required throttle valve position TVOR when the required throttle valve position TVOR changes in a stepped fashion from the value TVOR1 to the value TVOR2, as shown in FIG. 6A, since the return spring 34 provides no resilient force urging the auxiliary throttle valve 30 in the opening direction. In this case, the integral correction term IS starts decreasing at a time when the detected throttle valve position TVO overshoots the required throttle valve position TVOR and is held below the reference value S2 when the count of the timer counter exceeds the predetermined value TA, as shown in FIG. 6B.

It is, therefore, possible to detect a failure of the return spring 34 by comparing the integral correction term IS with the reference value S2 at a timer after the detected throttle valve position comes into coincidence with the required throttle valve position (except for the fully-open situation when the return spring urges the throttle valve in an opening direction in or fully-closed position when the return spring urges the throttle valve in a closing direction) or after the count TA of the timer counter exceeds the predetermined value TA. It is apparent from FIGS. 6A and 6B that the detected throttle valve position TVO has converged to the required throttle valve position TVOR when the count of the timer counter exceeds the predetermined value TA. Thus, the failure signal may be produced when the integral correction term IS is zero after the sensed throttle valve position TVO converges to the required throttle valve position TVOR.

Although return spring failure is checked from a comparison of the integral correction term IS with the reference value S2, it is to be understood, of course, that the return spring failure may be detected from a comparison of the sum total ER calculated at the point 208 with a predetermined value.

Although the throttle position control apparatus has been described in connection with closed loop control employing integral, proportional and differential correction terms, it is to be understood, of course, that it is equally applicable to integral plus proportional control employing integral and proportional correction terms.

Although the throttle valve control apparatus is described in connection with a tandem throttle valve mechanism, it is to be understood, of course, that it is equally applicable to a single throttle valve mechanism where only a single throttle valve is provided in the air induction passage. In this case, a return spring is used to urge the throttle valve in a closing direction.

Figure 7:
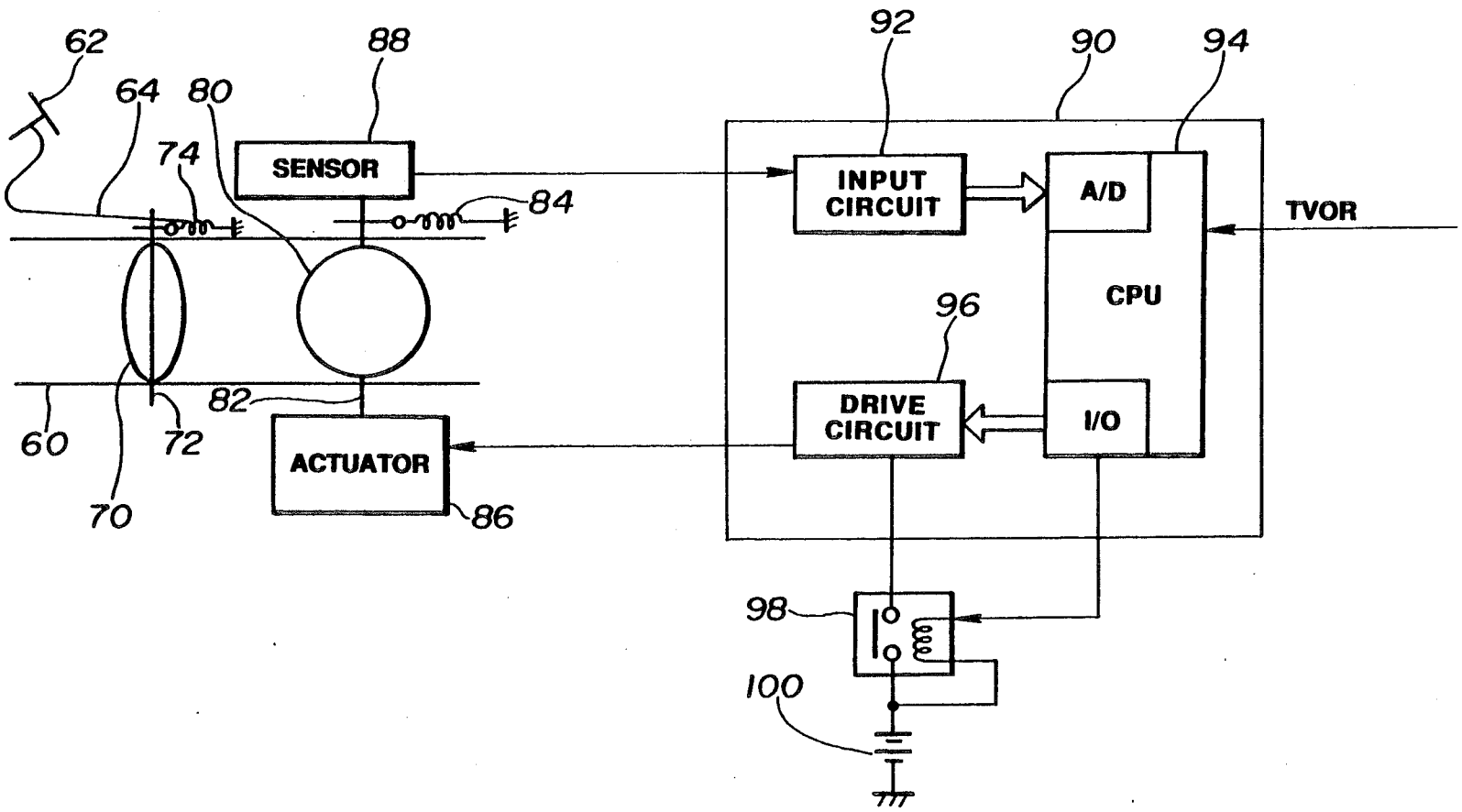
FIG. 7 is a schematic diagram showing a second embodiment of the throttle valve control apparatus of the invention.

Referring to FIG. 7, there is shown a third embodiment of the throttle valve control apparatus of the invention. In the illustrated case, the throttle valve control apparatus is used with a tandem throttle valve mechanism having main and auxiliary butterfly throttle valves 70 and 80 located in series within an air induction passage 60. The main throttle valve 70 is mounted for rotation with a throttle shaft 72 within the air induction passage 60 for controlling the flow of air to the engine (not shown) so as to adjust the speed of rotation of the engine. The main throttle valve 70 is urged in a closing direction by a return spring 74. The main throttle valve 70 is connected by an accelerator wire 64 to an accelerator pedal 62 manually controlled by the driver. The degree to which the accelerator pedal 62 is depressed controls, through the accelerator wire 64, the degree of rotation of the main throttle valve 70. The greater the depression of the accelerator pedal 62, the greater the amount of air permitted to enter the engine.

The auxiliary throttle valve 80 is mounted as for rotation with a throttle shaft 82 within the air induction passage 60 for controlling the flow of air to the engine. The auxiliary throttle valve 80 is urged in an opening direction by a return spring 84. The auxiliary throttle valve 80 is connected to an actuator 86 which may include a servo motor for rotating the throttle shaft 82 to move the auxiliary throttle valve 80 between its fully-open and fully-closed positions. The degree of rotation of the auxiliary throttle valve 80, this being determined by the magnitude of a control signal applied to the actuator 86, is determined from calculations performed by a control unit 90. For this purpose, the control unit 90 has an input from a throttle position sensor 88. The throttle position sensor 88 is connected by a mechanical link to the auxiliary throttle valve 80 for detecting the degree of opening of the auxiliary throttle valve 80. The throttle position sensor 88 may be a potentiometer electrically connected in a voltage divider circuit for supplying a detected throttle position signal in the form of a DC voltage proportional to the detected auxiliary throttle valve position. In the illustrated case, the DC voltage has a greater value as the amount of the auxiliary throttle valve 80 is opened increases.

The control unit 90 includes an input circuit 92 which receives the detected throttle position signal from the throttle position sensor 88 and removes noise which may be superimposed on the detected throttle position signal. The detected throttle position signal is then fed from the input circuit 92 to a control circuit 94. The control circuit 94 also receives a required throttle position signal indicative of a required auxiliary throttle valve position from a traction control unit (not shown). The traction control unit, which is substantially the same as described in connection with FIG. 1, repetitively sets a required throttle position based upon the slip factor of the vehicle drive wheels and the like for traction control. The control circuit 94 compares the detected and required throttle valve positions to provide a closed loop throttle valve control signal containing, integral, proportional and differential correction terms generated in response to the sensed deviation of the detected throttle valve position from the required throttle valve position. The closed loop throttle valve control signal is applied to a drive circuit 96 which converts it into a corresponding control signal causing the actuator 86 to make a required change in the position of the auxiliary throttle valve 80 in a direction zeroing the sensed deviation. The drive circuit 96 operates on power supplied from a power source 100 through a relay controlled switch 98. The control circuit 94 also performs the function of checking failure of the return spring 84 and performing a fail-safe operation in the event of failure of the return spring 84. The fail-safe operation includes producing a fail-safe signal to open the relay controlled switch 98 so as to disconnect the drive circuit 96 from the battery 100.

The control circuit 94 may employ a digital computer which shall be regarded as including an analog-to-digital converter (A/D), a central processing unit (CPU), a read only memory (ROM), a random access memory (RAM), a nonvolatile memory, a timer counter, and an input/output control unit (I/O). The read only memory contains the program for operating the central processing unit.

Figure 8:
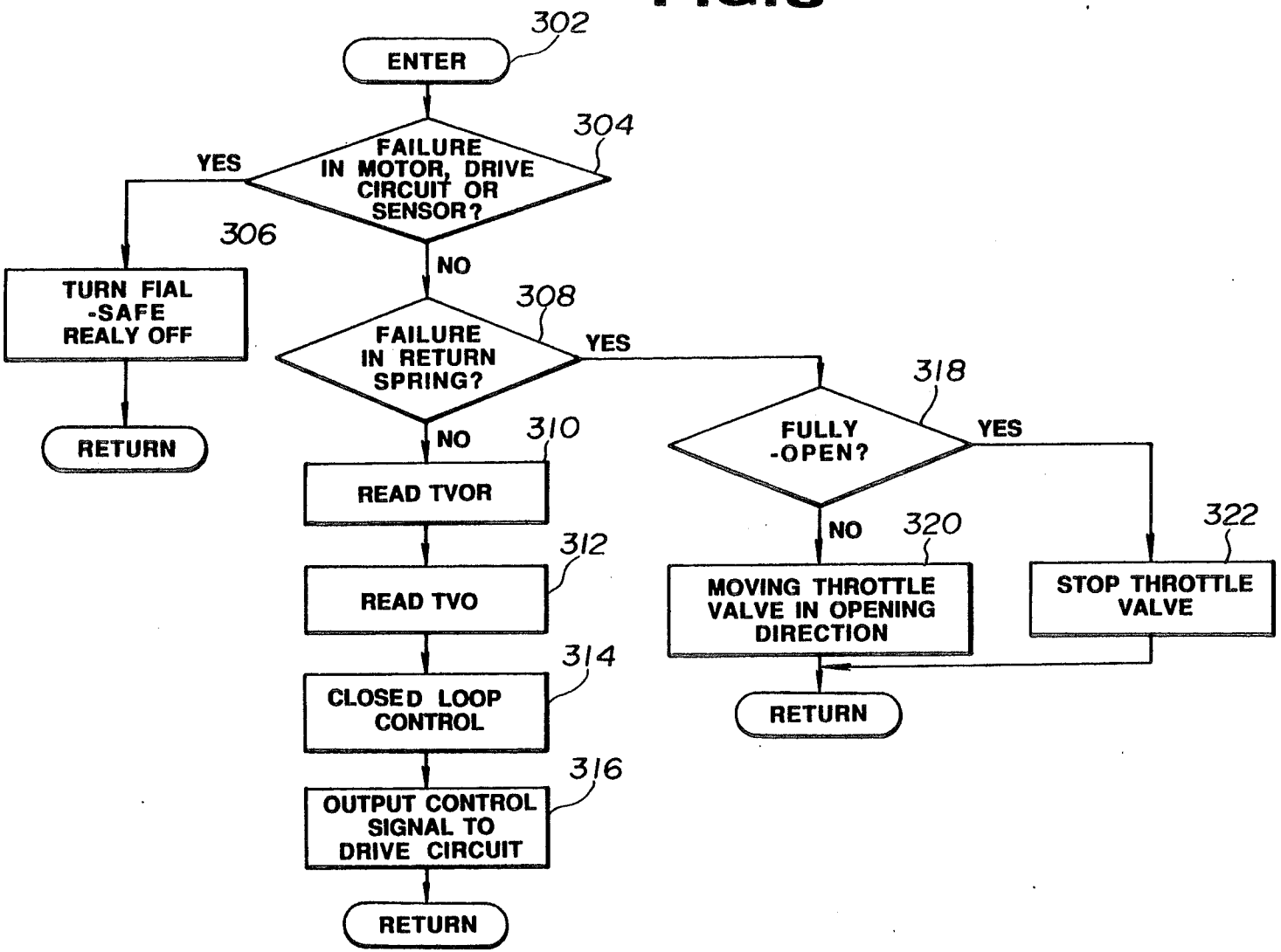
FIG. 8 is a flow diagram illustrating the programming of the digital computer used in the control circuit of FIG. 6.

FIG. 8 is a flow diagram illustrating the programming of the digital computer used in the control circuit 94.

The computer program is entered at the point 302. At the point 304 in the program, a determination is made as to whether or not a failure occurs in any one of the actuator 86, the throttle position sensor 88 and the drive circuit 96. This determination is made by monitoring the output voltages of the actuator 86, the throttle position sensor 88 and the drive circuit 96. If the answer to this question is "yes", then the program proceeds to the point 305 where a fail-safe signal is produced to open the relay controlled switch 98 so as to disconnect the drive circuit 96 from the battery 100. This permits the return spring 84 to move the auxiliary throttle valve 80 to its fully-open position (fail-safe position) and to hold it in the fully-open position. Following this, the program is returned to the entry point 302.

If the answer to the question inputted at the point 304 is "no", then the program proceeds to another determination step at the point 308. This determination is as to where the return spring 84 is subject to failure. This determination may be made in such a manner as describe in connection with the flow diagram of FIG. 2. If the answer to this question is "yes", then the program proceeds to the point 318. Otherwise, the program proceeds to the point 310.

At the point 310 in the program, the required throttle valve position TVOR is read into the computer memory. At the point 312 in the program, the auxiliary throttle valve position signal is converted, by the A/D converter, into digital form and the detected throttle valve position TVO is read into the computer memory. At the point 314 in the program, the central processing unit performs a closed loop throttle valve control. For this purpose, the central processing unit compares the detected and required auxiliary throttle valve positions TVO and TVOR to provide a closed loop throttle valve control signal. At the point 316 in the program, the closed loop throttle valve control signal is outputted to the drive circuit 96 which thereby rotate the auxiliary throttle valve 80 in a direction zeroing the deviation of the detected throttle valve position TVO from the required throttle valve position TVOR. Following this, the program is returned to the entry point 302.

At the point 318 in the program, a determination is made as to whether or not the auxiliary throttle valve 80 is in its fully-open position. If the answer to this question is "no", then the program proceeds to the point 320 where a command is produced for the drive circuit 96, causing the actuator 86 to move the auxiliary throttle valve 80 in the opening direction. Following this, the program is returned to the entry point 302. If the answer to the question inputted at the point 318 is "yes", then the program proceeds to the point 322 where a command is produced for the drive circuit 96, causing the actuator 86 to stop the auxiliary throttle valve 80. Thus, the auxiliary throttle valve 80 is held in its fully-open position (fail-safe position) when the return spring 84 is subject to failure. Following this, the program is returned to the entry point 302.

Although the throttle valve control apparatus has been described in connection with a return spring used to urge a throttle valve in an opening direction, it is to be understood, of course, that it may be used with a return spring used to urge a throttle valve in a closing direction. In this case, the control circuit 94 is arranged to move the throttle valve in a closing direction when the return spring is subject to failure and to stop the actuator so as to maintain the throttle valve in its fully-closed position when the throttle valve reaches the fully-closed position.

Although the throttle valve control apparatus is described in connection with a tandem throttle valve mechanism, it is to be understood, of course, that it is equally applicable to a single throttle valve mechanism where only a single throttle valve is provided in the air induction passage. In this case, a return spring is used to urge the throttle valve in a closing direction.

What is claimed is:

1. An apparatus for use with an internal combustion engine having a throttle valve movable between a fully-open position and a fully-closed position within an induction passage for controlling air flow to said engine, and a return spring for urging said throttle valve in an opening direction, said apparatus comprising:

a throttle position sensor sensitive to a position of said throttle valve for generating an electric signal indicative of a sensed position of said throttle valve;

a signal source for generating an electric signal indicative of a required position of said throttle valve;

a throttle actuator operable in response to a control signal for moving said throttle valve to said required position;

a control unit connected to said throttle position sensor, said signal source and said throttle actuator for producing said control signal for said throttle actuator based upon said sensed position and said required position of said throttle valve, said control unit including means for comparing a throttle valve position sensed in the absence of said control signal with a predetermined value to produce a failure signal indicative of a failure of said return spring when said throttle position sensed in the absence of said control signal is less than said predetermined value.

2. The apparatus as claimed in claim 1, wherein said predetermined value corresponds to said fully-open position of said throttle valve.

3. An apparatus for use with an internal combustion engine having a throttle valve movable between a fully-open position and a fully-closed position within an induction passage for controlling air flow to said engine, and a return spring for urging said throttle valve in a closing direction, said apparatus comprising:

a throttle position sensor sensitive to a position of said throttle valve for generating an electric signal indicative of a sensed position of said throttle valve;

a signal source for generating an electric signal indicative of a required position of said throttle valve;

a throttle actuator operable in response to a control signal for moving said throttle valve to said required position;

a control unit connected to said throttle position sensor, said signal source and said throttle actuator for producing said control signal for said throttle actuator based upon said sensed position and said required position of said throttle value, said control unit including means for comparing a throttle valve position sensed in the absence of said control signal with a predetermined value to produce a failure signal indicative of a failure of said return spring when said throttle position sensed in the absence of said control signal is greater than said predetermined value.

4. The apparatus as claimed in claim 3, wherein said predetermined value corresponds to said fully-closed position of said throttle valve.

5. An apparatus for use with an internal combustion engine having a throttle valve movable between a fully-open position and a fully-closed position within an induction passage for controlling air flow to said engine, and a return spring for urging said throttle valve in a given direction, said apparatus comprising:

a throttle position sensor sensitive to a position of said throttle valve for generating an electric signal indicative of a sensed throttle valve position;

a signal source for generating an electric signal indicative of a required throttle valve position;

a throttle actuator operable in response to a control signal for moving said throttle valve to said required throttle valve position; and a control unit connected to said throttle position sensor, said signal source and said throttle actuator for providing closed loop throttle position control employing an integral correction amount in response to a sensed deviation of said sensed throttle valve position from said required throttle valve position so as to produce said control signal, said control unit including means for comparing said integral correction amount with a predetermined value to produce a failure signal indicative of a failure of said return spring after said sensed throttle valve position converges to said required throttle valve position.

6. The apparatus as claimed in claim 5, wherein said control unit includes means for producing said failure signal when said integral correction amount is zero after said sensed throttle valve position converges to said required throttle valve position.

7. The apparatus as claimed in claim 5, wherein said control unit includes means for measuring a time interval during which said sensed throttle valve position is held in a first predetermined range around said required throttle valve position after said sensed throttle valve position comes into said first predetermined range, means for producing a first signal when said time interval exceeds a predetermined value, and means for producing said failure signal when said integral correction amount is zero in the presence of said first signal.

8. The apparatus as claimed in claim 5, wherein said control unit includes means for producing said failure signal when said integral correction amount comes into a predetermined range around zero after said sensed throttle valve position converges to said required throttle valve position.

9. The apparatus as claimed in claim 5, wherein said control unit includes means for measuring a time interval during which said sensed throttle valve position is held in a first predetermined range around said required throttle valve position after said sensed throttle valve position comes into said first predetermined range, means for producing a first signal when said time interval exceeds a predetermined value, and means for producing said failure signal when said integral correction amount comes into a second predetermined range around zero in the presence of said first signal.

10. An apparatus for use with an internal combustion engine having a throttle valve movable between a fully-open position and a fully-closed position within a induction passage for controlling air flow to said engine, and a return spring for urging said throttle valve in a given direction, said apparatus comprising:

a throttle position sensor sensitive to a position of said throttle valve for generating an electric signal indicative of a sensed throttle valve position of said throttle valve;

a signal source for generating an electric signal indicative of a required throttle valve position of said throttle valve;

a throttle actuator operable in response to a control signal for moving said throttle valve to said required throttle valve position; and a control unit connected to said throttle position sensor, said signal source and said throttle actuator for providing closed loop throttle position control in response to a sensed deviation of said sensed throttle valve position so as to produce said control signal for said throttle actuator, said control unit including means for detecting a failure of said return spring to produce a failure signal in the event of failure of said return spring, and means responsive to said failure signal for inhibiting said closed loop throttle position control and holding said throttle valve at a predetermined fail-safe position.

11. The apparatus as claimed in claim 10, wherein said return spring urges said throttle valve in an opening direction, and wherein said control unit includes means responsive to said failure signal for holding said throttle valve in said fully-open position.

12. The apparatus as claimed in claim 10, wherein said return spring urges said throttle valve in a closing direction, and wherein said control unit includes means responsive to said failure signal for holding said throttle valve in said fully-closed position.

* * * * *